US006319035B1

(12) United States Patent
Choy

(10) Patent No.: US 6,319,035 B1
(45) Date of Patent: Nov. 20, 2001

(54) DUPLEX PROFILE CONNECTOR ASSEMBLY

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/619,864

(22) Filed: Jul. 20, 2000

Related U.S. Application Data

(63) Continuation-in-part of application No. 09/498,828, filed on Feb. 4, 2000, which is a continuation-in-part of application No. 09/084,809, filed on May 26, 1998, now Pat. No. 6,126,472, which is a continuation of application No. 08/692,823, filed on Jul. 29, 1996, now Pat. No. 5,755,585, which is a continuation-in-part of application No. 08/393,704, filed on Feb. 24, 1995, now Pat. No. 5,833,478.

(51) Int. Cl.[7] ..... H01R 13/62
(52) U.S. Cl. ..... 439/326
(58) Field of Search ..... 439/325–328, 439/541.5, 64, 79

(56) References Cited

U.S. PATENT DOCUMENTS 4,747,790 * 5/1988 Masuda et al. ..... 439/326
5,030,115 * 7/1991 Regnier et al. ..... 439/541.5
5,176,523 * 1/1993 Lai ..... 439/541.5
5,415,573 * 5/1995 Chen et al. ..... 439/326
5,641,295 * 6/1997 Koyama ..... 439/326
5,697,802 * 12/1997 Kawabe ..... 439/326
5,839,913 * 11/1998 Fumikura ..... 439/326
5,993,234 * 11/1999 Yodogawa ..... 439/326
6,077,098 * 6/2000 Yu et al. ..... 439/326

* cited by examiner

*Primary Examiner*—Gary F. Paumen
(74) *Attorney, Agent, or Firm*—Wei Te Chung

(57) ABSTRACT

A double-deck connector assembly (1) includes a unitary housing (10) defining upper and lower connection ports (12, 14) with upper and lower central slots (16, 17) for respectively receiving the corresponding upper and lower modules (100, 200) therein. The upper connection port (12) is slightly forwardly offset from the lower connection port (14). A pair of latching arms (20, 22) extend from two opposite ends of each connection port (12, 14) for retaining the corresponding module (100, 200) in position. A latching lug (28, 34) is formed on each latching arm (20, 22) for locking the module (100, 200) in position. The lower module (200) is allowed to be inserted into the lower connection port (14) with the initial angular insertion position which is substantially above the latching lug (28) of the upper latch arm (20) under the condition that the upper connection port (12) is only slightly forwardly offset from the lower connection port (14).

1 Claim, 13 Drawing Sheets

DUPLEX PROFILE CONNECTOR ASSEMBLY (This is a continuation-in-part of the application Ser. No. 09/498,828 filed Feb. 4, 2000, which is a continuation-in-part of the application Ser. No. 09/084,809 filed May 26, 1998, now U.S. Pat. No. 6,126,472 which is a continuation of application Ser. No. 08/692,823 filed Jul. 29, 1996, now U.S. Pat. No. 5,755,585, which is a continuation-in-part of application Ser. No. 08/393,704 filed Feb. 24, 1995, now U.S. Pat. No. 5,833,478.)

BACKGROUND OF THE INVENTION

1. Field of the Invention

The invention relates to double deck connector assemblies, and particularly to the connector including the housing defining upper and lower ports each with a pair of latch devices aside for retaining therein the corresponding module wherein the main body of the upper port and that of the lower port are vertically aligned with a minimum offset in a front-to-back direction.

2. The Related Art

As known, till now most double-deck SO DIMM (Dual Inline Memory Module) or Mini SIMM (Single Inline Memory Module) connectors generally require a relatively significant offset between the upper connection port and the lower connection port in a front-to-back direction, or require a relatively significant distance or gap between the upper connection port and the lower connection port in a vertical direction, whereby the lower module, which is ready to be inserted into the lower connection port, is able to approach the lower connection portion at an angle with its upper surface substantially positioned below the latching lug of the upper latch for avoiding improper interference between the lower module and the latching lug of the upper latch during downward rotation of the lower module for reaching its final horizontal final fixed position. U.S. Pat. Nos. 5,697,802 (FIGS. 6, 7), 5,641,295 (FIG. 3), 5,993,234, and 5,755,585 (the grand parent application of the invention) generally disclose this character. Anyhow, only U.S. Pat. No. 5,833,478 (the '478 patent which is the great grand parent application of the invention with the same assignee) show the vertically aligned upper and lower connection ports without any offset thereof, and the lower module may pass over the latching lug of the upper latch aside for approaching and engaging the lower latch. According to the main figure of the '478 patent, because the imperfect interengagement/interrelationship between the latching lug of the upper latch and the notch of the lower module, the notch is essentially formed to be relatively much larger than the standard size for avoiding any improper interference with the latching lug of the upper latch. Under this situation, the structure disclosed in the '478 patent may not be fully acceptable in the industry.

Therefore, an object of the invention is to provide a double-deck SO DIMM connector assembly including a housing defining upper and lower ports, wherein the position and the contour of the latching lug of the upper latch have been properly and precisely configured so as to allow the lower level module to be easily inserted into the lower connection port without interference therewith under the condition of relatively little offset arrangement of the upper connection port and the lower connection port in the front-to-back direction of the connector assembly.

Another object of the invention is to provide two-step withdrawal of the lower level module wherein the lower level module is first released by deflection of the latching lug of the lower latch while still being retained by the latching lug of the upper latch, and then successively fully released by deflection of the latching lug of the upper latch.

SUMMARY OF THE INVENTION

According to an aspect of the invention, a double-deck connector assembly includes a unitary housing defining upper and lower connection ports with upper and lower central slots for respectively receiving the corresponding upper and lower modules therein. The upper connection port is slightly forwardly offset from the lower connection port. A pair of latching arms extend from two opposite ends of each connection port for retaining the corresponding module in position. A latching lug is formed on each latching arm for locking the module in position wherein the latching lug of the lower latch arm includes a vertical section received within the notch of the lower module and a horizontal section, which is integrally connected to the vertical section, abutting against and positioned on the upper surface of the lower module around the periphery of the corresponding notch, while the latching lug of the upper latch arm includes a vertical section received within the corresponding notch of the upper module and a horizontal section, which is integrally connected to the vertical section, abutting against and positioned on the upper surface of the upper module around the side edge close to said notch. Therefore, the lower module is allowed to be inserted into the lower connection port with the initial angular insertion position which is substantially above the latching lug of the upper latch arm under the condition that the upper connection port is only slightly forwardly offset from the lower connection port. The dimension, position and contour of the latching lug of the upper latch arm are properly configured to correlate the (standard) notch of the lower module for allowing insertion/withdrawal of the lower module with regard to the connector housing via deflection of the upper latch arm.

Additionally, such withdrawal of the lower module is arranged to be done via two steps wherein the lower module is first rotated from the horizontal locking position back to an intermediate angular position after deflection of the latching lug of the lower latch arm while still be retained by the latching lug of the upper latch arm. Successively, the lower module is rotated from the intermediate angular position to the final withdrawal angular position, (which is also the initial insertion angular position,) for fully leaving the connector housing.

DETAILED DESCRIPTION OF THE PREFERRED EMBODIMENTS

Figure 1:
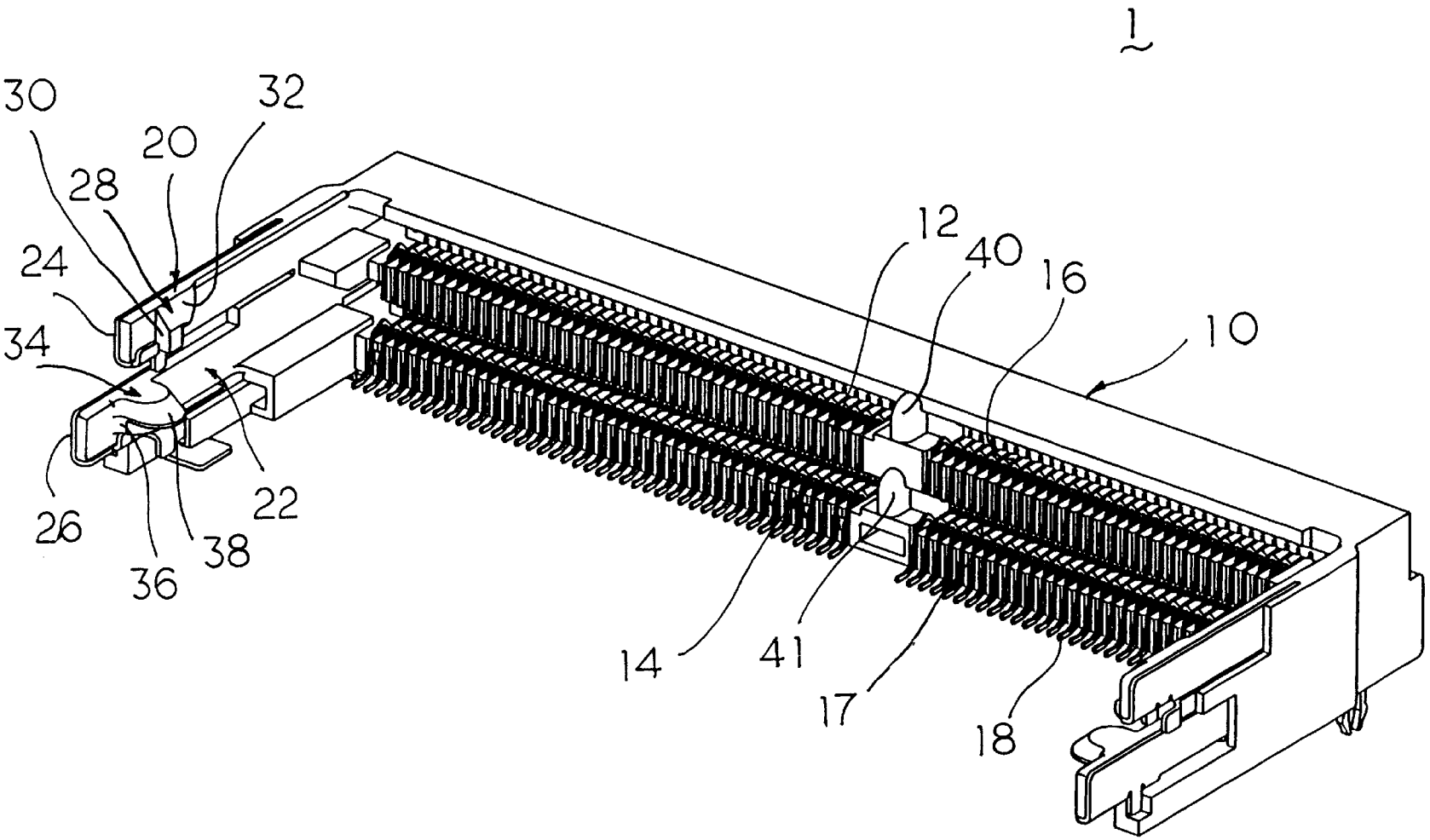
FIG. 1 is a perspective view of a double-deck connector assembly according to the invention.
Figure 2:
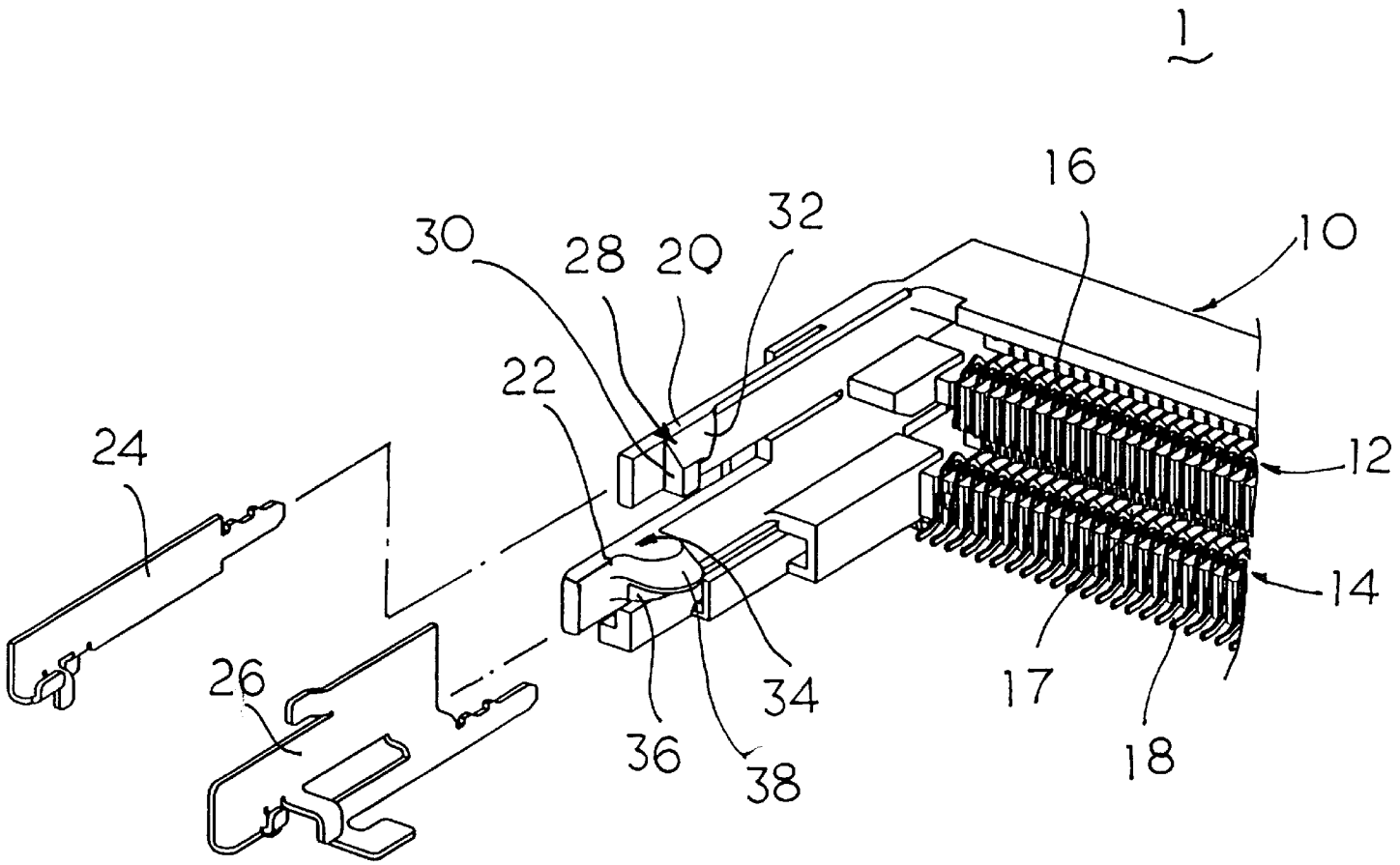
FIG. 2 is an exploded partial perspective view of the connector assembly of FIG. 1.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–11 wherein a double-deck connector assembly 1 includes an insulative housing 10 defining an upper connection port 12 and a lower connection port 14 for respectively receiving upper and lower (level) modules 100, 200 therein. The upper(lower) connection port 12, 14 includes an upper(lower) central slot 16(17) with a plurality of contacts 18 aside. The upper connection port 12 is somewhat forwardly offset from the lower connection port 14 in a front-to-back direction of the connector assembly 1.

A pair of upper(lower) latch arms 20(22) are respectively integrally formed at two opposite ends of the upper(lower) connection portion 12(14). A metal supporting arm 24(26) is disposed beside each latch arm 20(22) and directly fastened to the housing 10 for provision of auxiliary strength of the latch arm 20(22) during deflection of the latch arm 20(22).

A first or upper latching lug 28 is formed around the distal end of the upper latch arm 20, and includes a first vertical section 30 and a first horizontal section 32 mutually directly interconnected with each other. A second or lower latching lug 34 is formed around the distal end of the lower latch arm 22, and includes a second vertical section 36 and a second horizontal section 38 mutually interconnected with each other. Because the offset arrangement between the upper connection port 12 and the lower connection port 14, the first latching lug 28 of the upper latch arm 20 is also forwardly offset from the second latching lug 34 of the lower latch arm 22.

Figure 3:
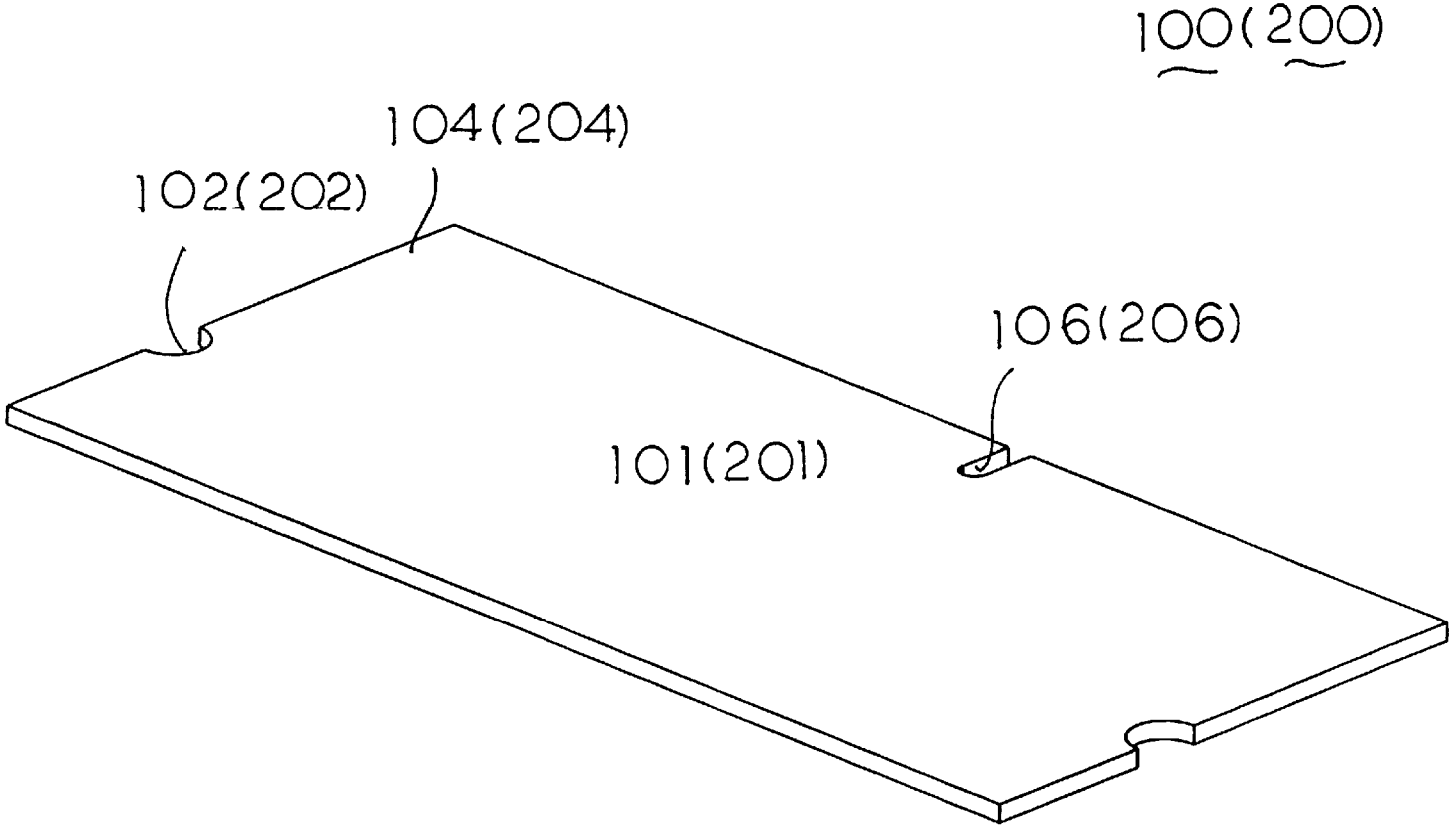
FIG. 3 is a perspective view of the printed circuit board module for use with the connector assembly of FIG. 1.

Referring to FIG. 3, the printed circuit board module 100(200) defines an upper surface 101(201) and an opposite undersurface (not labeled) with a pair of notch 102(202) in two lateral sides 104(204), and a keyway 106(206) in a front edge for cooperation with the key 40(41) in the central slot 16(17).

Figure 4:
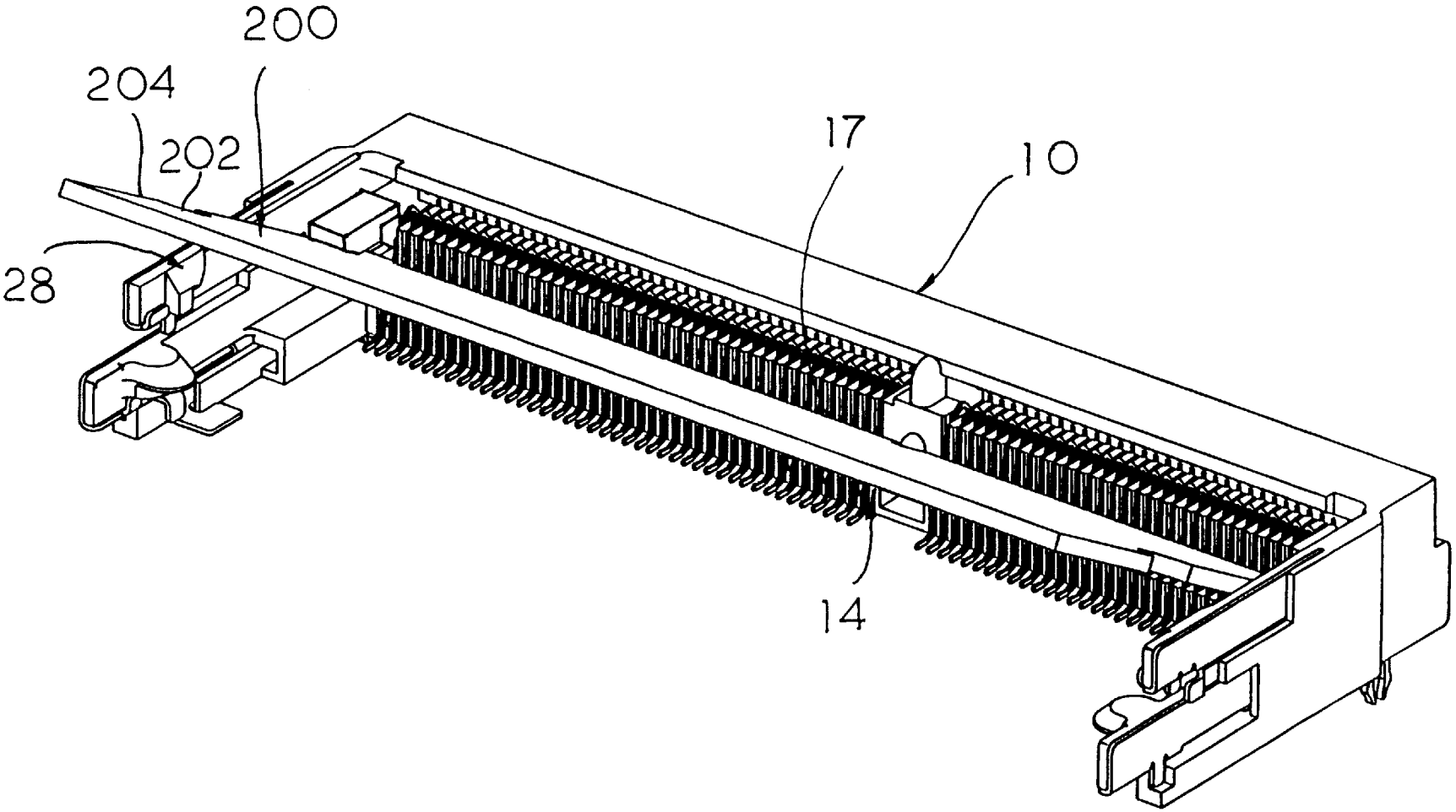
FIG. 4 is a perspective view of the connector assembly of FIG. 1 with the lower level module at an initial insertion angular position/a fully withdrawal angular position.
Figure 5:
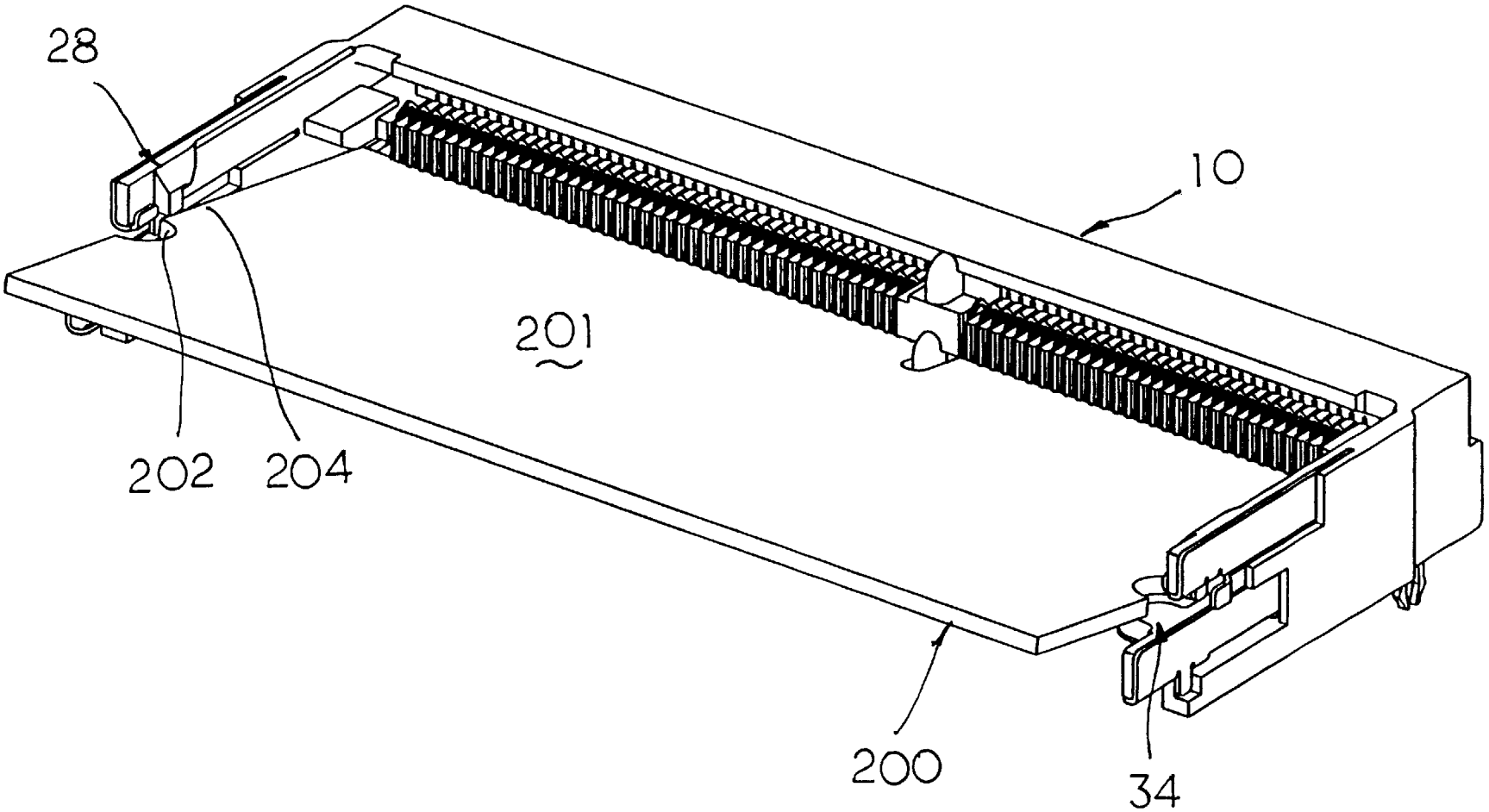
FIG. 5 is a perspective view of the connector assembly of FIG. 1 with the lower level module at an intermediate withdrawal/insertion angular position.
Figure 6:
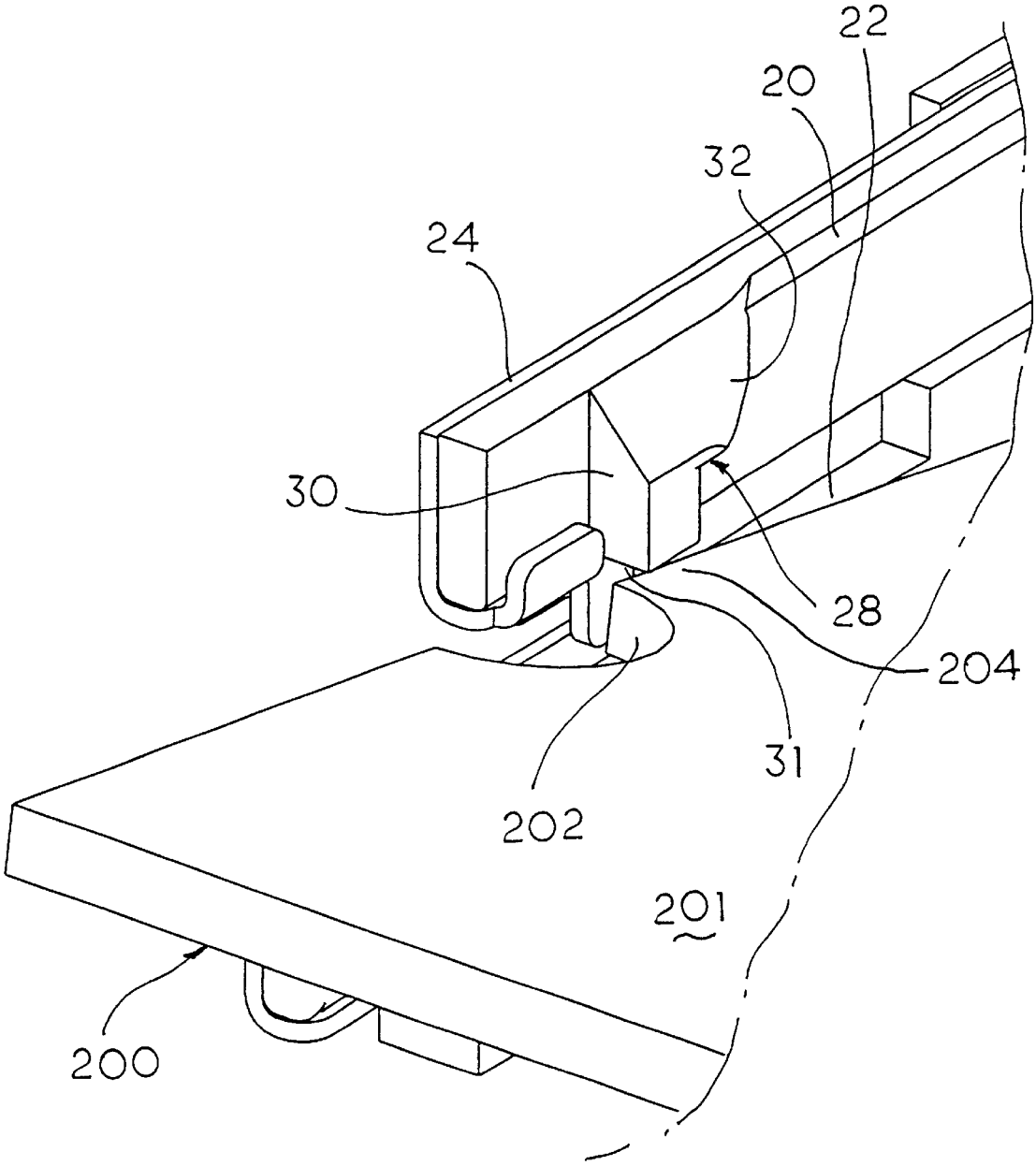
FIG. 6 is an enlarged perspective view of the connector assembly with the half inserted/withdrawn lower level module of FIG. 6 to show how the latching lug of the upper latch arm engages the lower level module.
Figure 7:
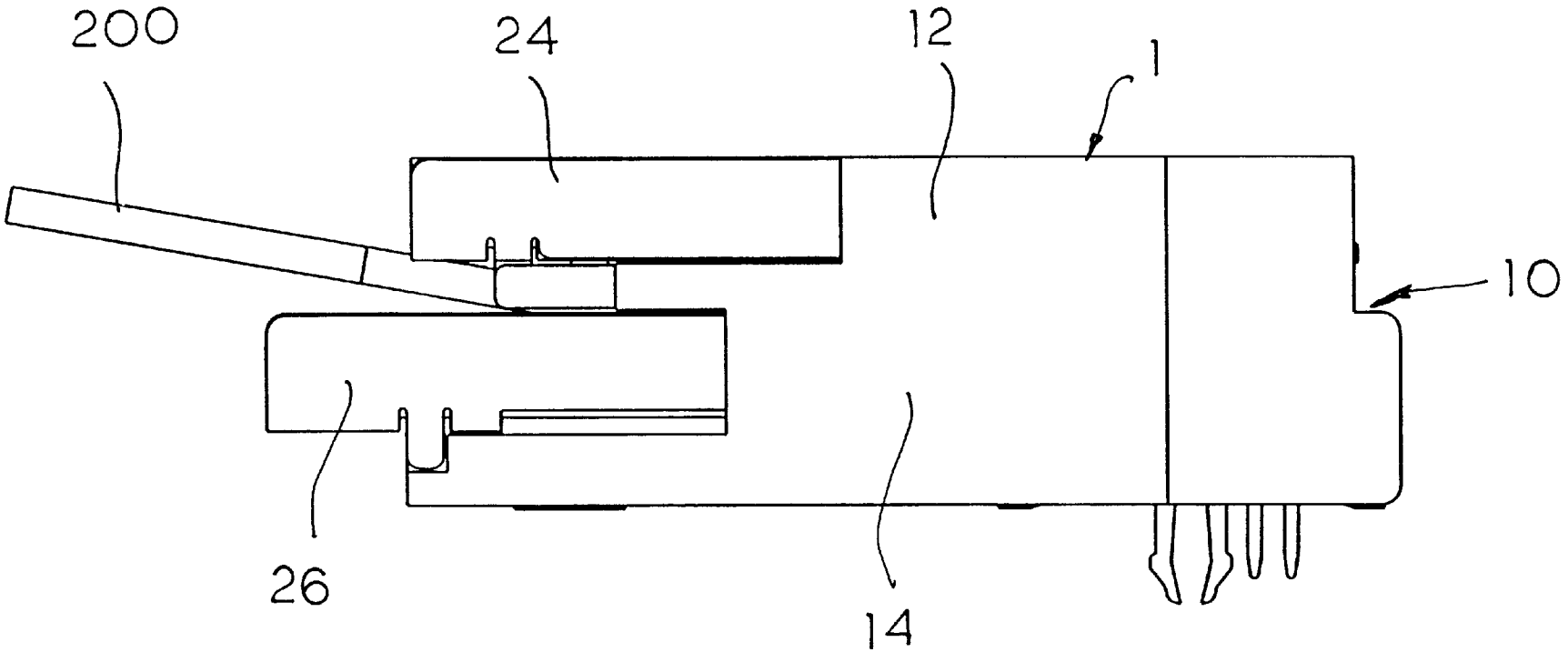
FIG. 7 is a side view of the connector assembly with the half inserted/withdrawn lower level module of FIG. 6.
Figure 8:
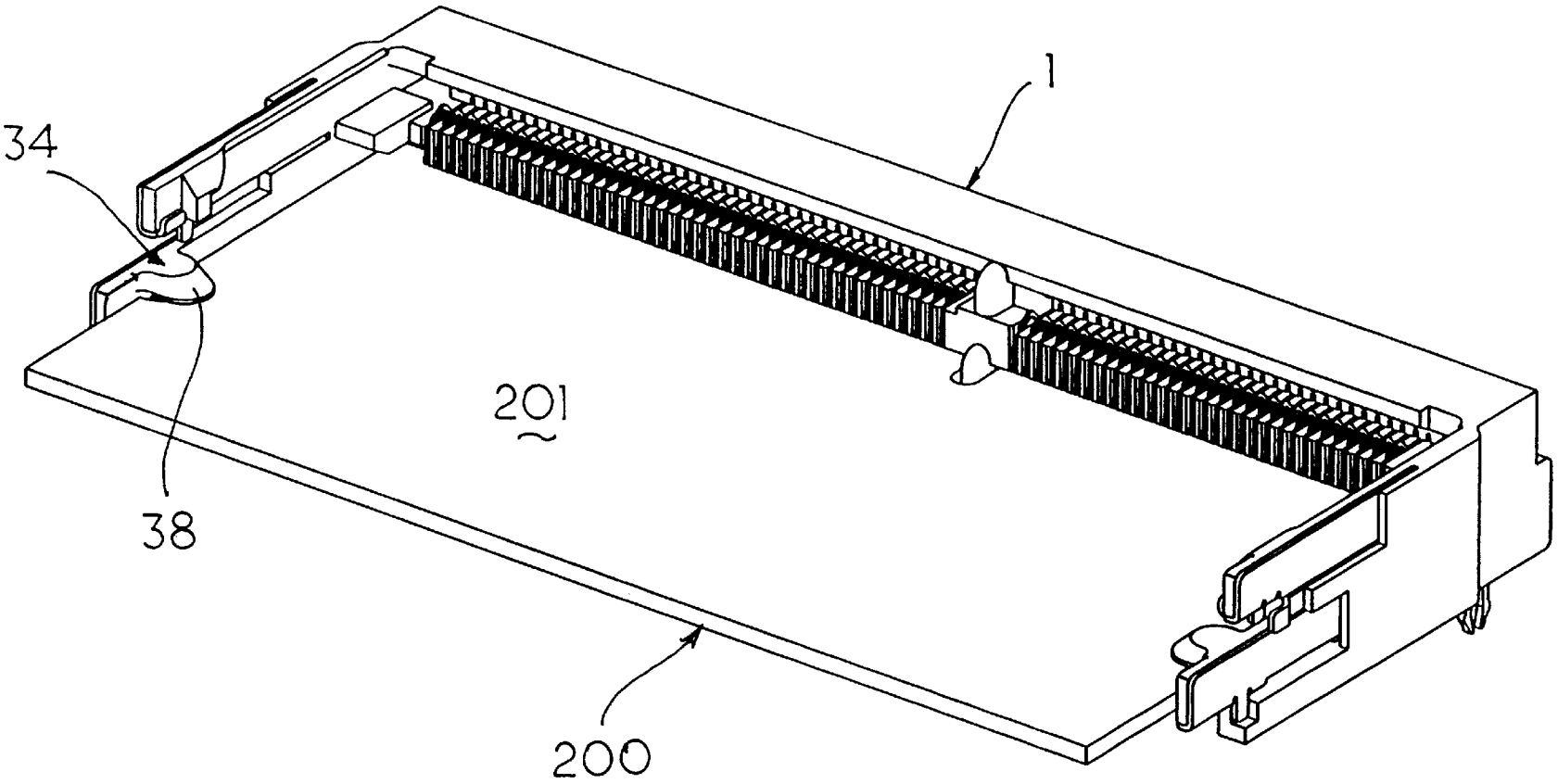
FIG. 8 is a perspective view of the connector assembly of FIG. 1 with the lower level module at a fully inserted locked horizontal position.

Referring to FIGS. 4–8, the lower module 200 is first installed into the lower connection port 14, with the front edge of the lower module 200 being received within the lower central slot 17, at an initial insertion or full withdrawal angular position as shown in FIG. 4 where the first latching lug 28 is positioned under the lower module 200.

Successively, the lower module 200 is downwardly rotated about the lower central slot 17, and thus the pair of upper latch arms 20 will be deflected outwardly by slidable engagement between the first latching lugs 28 and the lateral sides 204 of the lower module 200 until the lower module 200 completely passes over the first latching lugs 28 and retained in the intermediate insertion/withdrawal angular position which is between the first latching lug 28 and the corresponding second latching lug 34. Particularly referring to FIG. 6, in this angular position the bottom face 31 of the first latching lug 28 abuts against the lateral side 204 adjacent to the corresponding notch 202, for retaining the lower module 200 in position.

Lastly, the lower module 200 is continuously downwardly rotated to the completely locked horizontal position, by outwardly deflecting the lower latch arms 22, where the second vertical section 36 of the second latching lug 34 is received within the notch 202 of the lower module 20 while the second horizontal section 38 of the second latching lug 34 is seated upon, i.e., abutting against, the upper surface 201 of the lower module 200 around the periphery of the notch 202.

Figure 9:
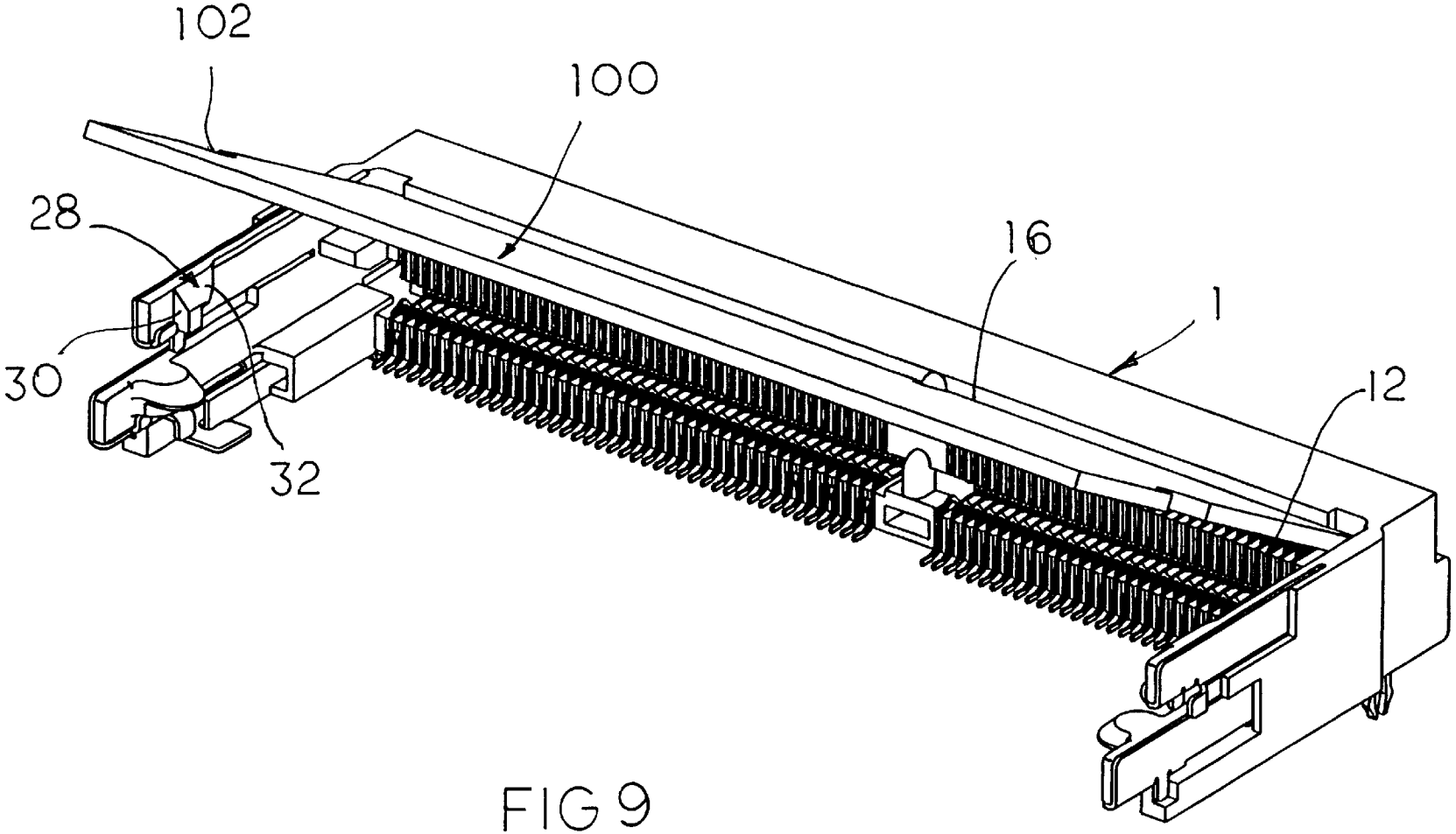
FIG. 9 is a perspective view of the connector assembly of FIG. 1 with the upper level module at the initial insertion or the fully withdrawal angular position.
Figure 10:
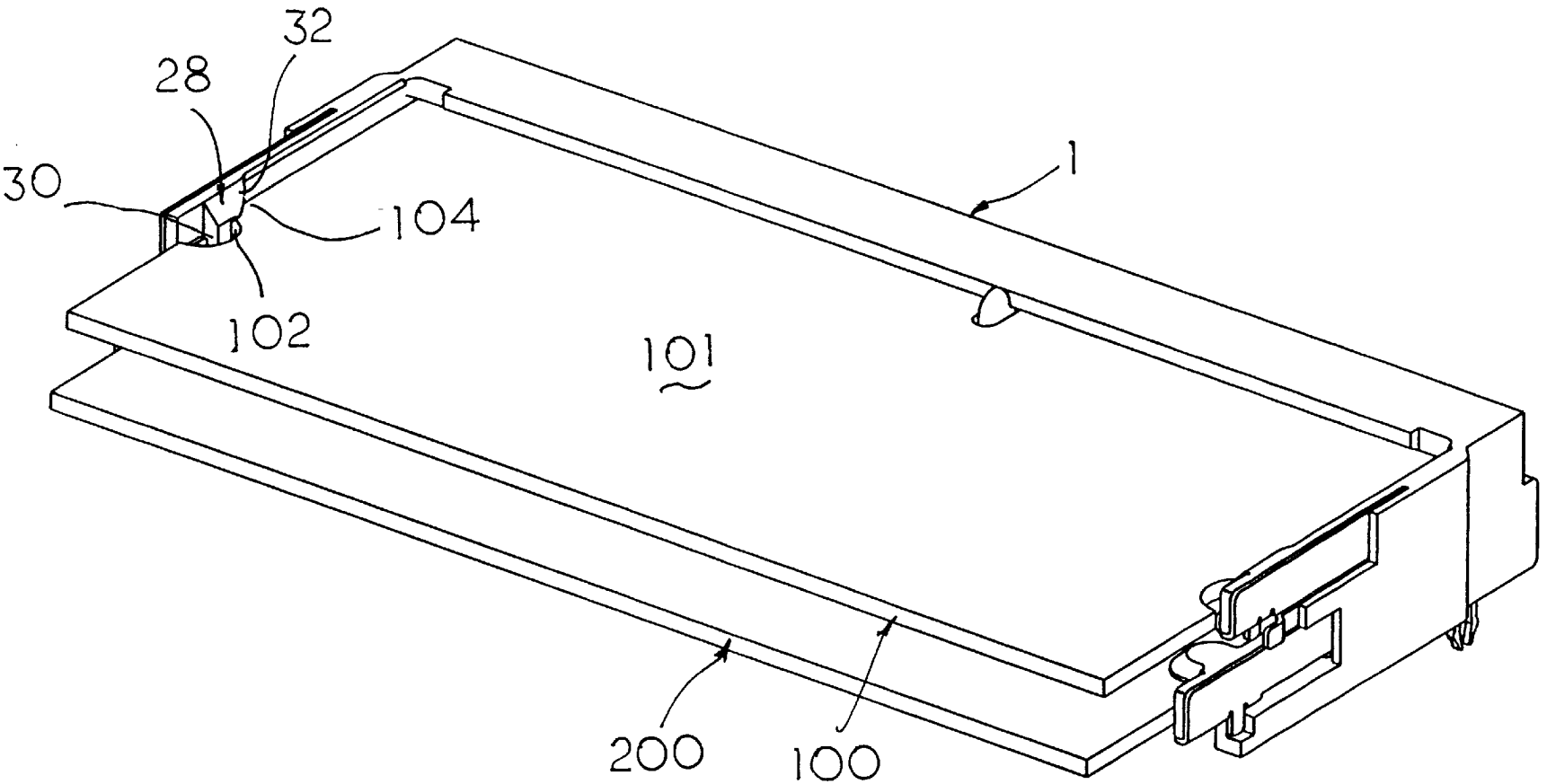
FIG. 10 is a perspective view of the connector assembly of FIG. 1 with both the upper level module and the lower level module completely installed/locked therein.
Figure 11:
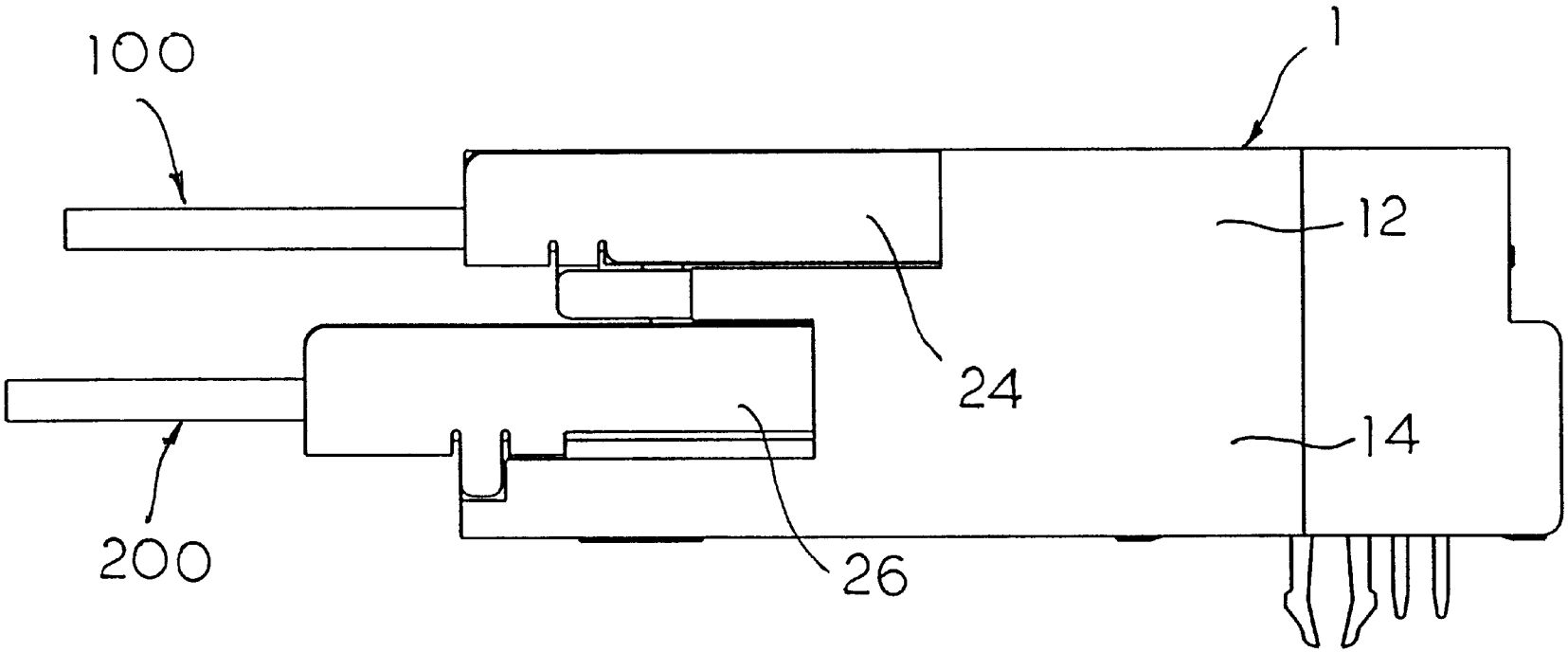
FIG. 11 is a side view of the connector assembly of FIG. 10.

Referring to FIGS. 9–11, the upper module 100 is then installed into the upper connection port 12, with the front edge of the upper module 100 being received within the upper central slot 16, at the initial insertion or full withdrawal angular position. Successively, the upper module 100 is downwardly rotated to a completely locked horizontal position, by outwardly deflecting the upper latch arms 20, where the first vertical section 30 is received within the notch 102 of the upper module 100 while the first horizontal section 32 is seated on (i.e., abutting against) the upper surface 101 of the upper module 100 around the side 104 adjacent to the notch 102.

Figure 12:
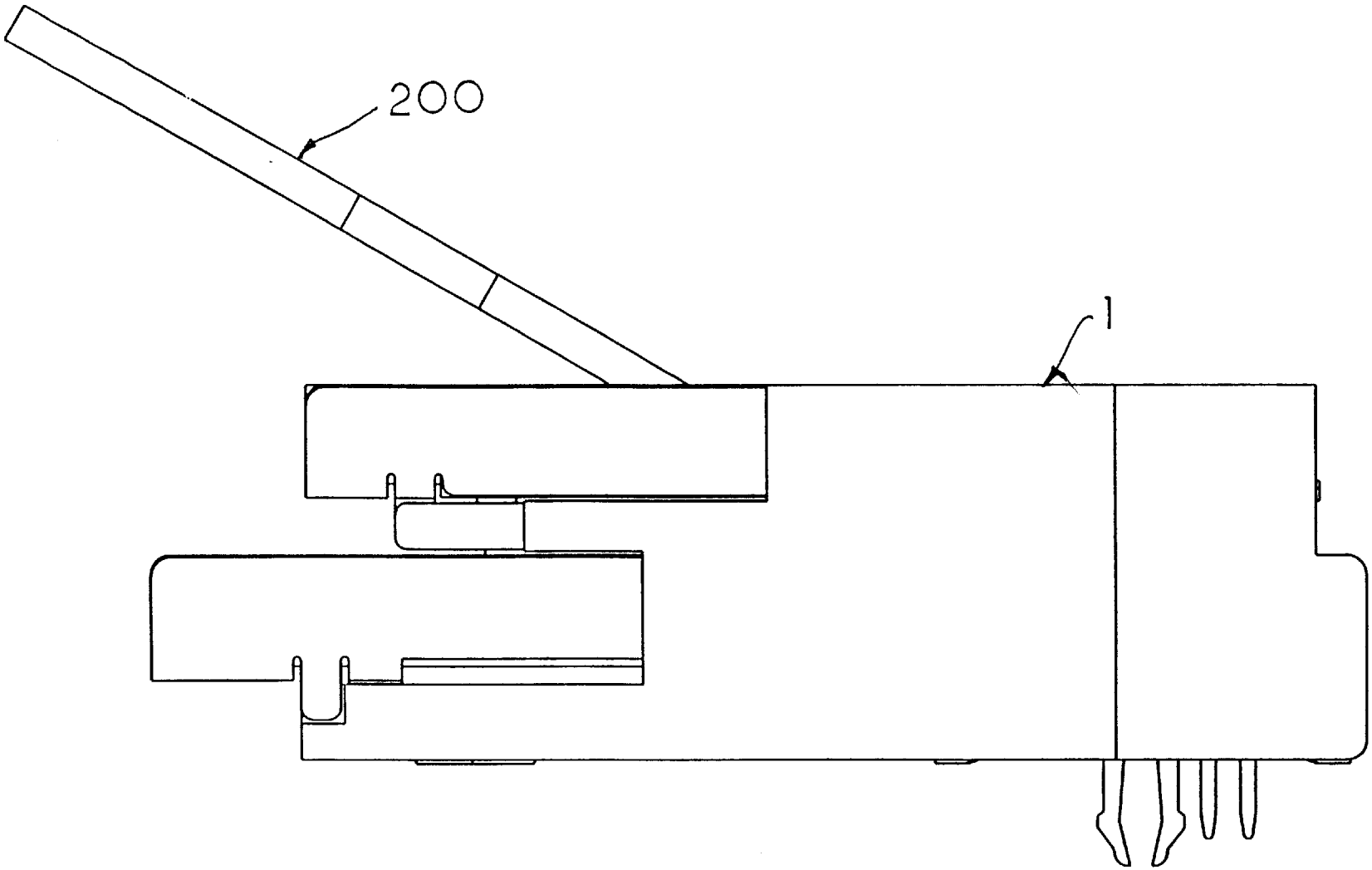
FIG. 12 is a side view of the connector assembly of FIG. 1 with therein the lower level module at the initial insertion or fully withdrawal angular position.
Figure 13:
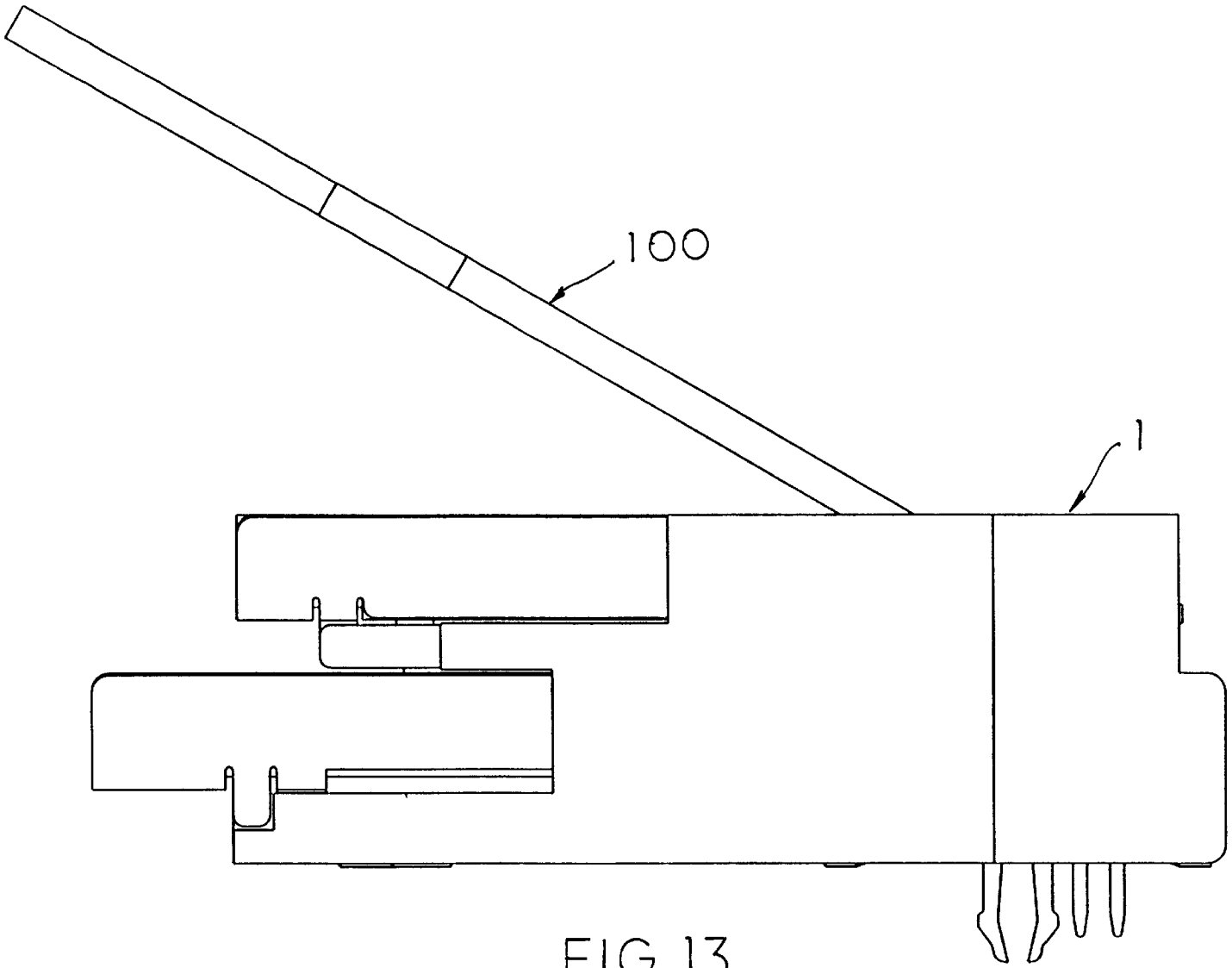
FIG. 13 is a side view of the connector assembly of FIG. 1 with the upper level module at the insertion/withdrawal angular position.

FIGS. 12 and 13 respectively show the initial insertion positions of the upper module 100 and of the lower module 200.

Oppositely, during withdrawal of the upper and the lower modules 100 and 200, the upper module 100 is first backwardly, i.e., upwardly, rotated from the horizontal position to the insertion/withdrawal angular position by outward deflection of the upper latch arms 20, and leaves the upper connection port 12.

Successively, the lower module 200 is first backwardly, i.e., upwardly, rotated from the horizontal position to the intermediate angular position, by outward deflection of the lower latch arms 22, where the lower module 200 is retained in position by the first latching lugs 28. The lower module 200 is successively backwardly rotated from the intermediate angular position to the full withdrawal/initial insertion angular position, by outwardly deflecting the upper latch arms 20, and then leaves the lower connection port 14.

In comparison with the prior arts, the invention comprising several features as follows.

(1) In most double-deck SO DIMM connector assemblies, the lower module is inserted into the lower connection port at an initial angular position essentially positioned between the upper latching lugs and the lower latching lugs, and thus resulting in inevitably a relatively larger offset arrangement between the upper connection port and the lower connection port, and correspondingly a relatively larger layout requirement on the printed circuit board which is undesired in the computer manufacturer. In opposite, in this invention through the precise and delicate position, contour and dimension arrangement between the upper latching lug and the lower latching lug, the lower module can be installed into the lower connection port with the initial angular position substantially above the upper latching lugs and the sequential downward rotation of the lower module will not result in any improper interference with the corresponding upper latching lugs and lower latching lugs. Therefore, the offset arrangement between the upper connection port and the lower connection port can be arranged with a minimum range, thus relatively saving the space on the printed circuit board layout.

(2) Because in most the prior art connector assembles the insertion or withdrawal of the lower connection port is operated under the latching lug of the upper latch arm, such operation is naturally done by only one rotation step. Differently, because in the invention the initial insertion or fully withdrawal angular position of the lower module is essentially above the latching lug of the upper latch arm, and an intermediate angular position is defined by temporary engagement between the side of the lower module and undersurface of the latching lug of the upper latch arm, a two-step operation of the lower module is obtained, thus making the whole operation easier, more controllable and systematic.

(3) In the invention both the upper latching lug and the lower latching lug may retain the corresponding upper module and lower module in both horizontal and vertical directions by their own respective vertical section and horizontal section.

(4) In the invention both the vertical section and the horizontal section of either the upper latching lug or the lower latching lug are integrally interconnected with each other without the gap therebetween for reinforcement of the respective structures thereof.

(5) It should be noted that the position of the vertical section of the upper latching lug should be carefully defined to abut against the upper surface, i.e., the side, of the lower module rather than falling within the notch of the lower module when the lower module is rotated to the intermediate angular position. Otherwise, an interference may occur during this two-step rotation operation of the lower module.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. For example, the housing may be made by two separate pieces to respectively form the upper and lower connection ports as shown in the parent U.S. Pat. No. 5,755,585. Similarly, the latch arms may not be integrally formed with the housing but being the separate pieces attached thereto.

Therefore, person of ordinary skill in this field are to understand that all such equivalent structures are to be included within the scope of the following claims.

I claim:

1. A double-deck connector assembly comprising:

an insulative housing defining upper and lower connection ports slightly offset from each other in a front-to-back direction thereof for therein respectively receiving upper and lower modules wherein both said upper module and said lower module are rotatively inserted thereinto;

a pair of upper latch arms extending from two opposite ends of the upper connection port;

a pair of lower latch arms extending from two opposite ends of the lower connection port;

a first latching lug formed on each of said pair of upper latch arms, and including a first vertical section and a first horizontal section integrally connected to each other;

a second latching lug formed on each of said pair of lower latch arms, and including a second vertical section and a second horizontal section integrally connected to each other; wherein said first latching lug and said second latching lug are positioned and configured to respectively retain the upper module and the lower module under a condition that the first vertical section is received within an upper notch of the upper module and the first horizontal section abuts against a side of an upper surface of the upper module adjacent to said upper notch, while the second vertical section is received within a lower notch of the lower module and the second horizontal section abuts against an upper surface of the lower module around a periphery of said lower notch:

wherein said first latching lug and said second latching lug are positioned and configured to allow the lower module to be installed into the lower connection port from an initial insertion angular position above the first latching lug;

wherein the first latching lug is configured to be adapted to temporarily engage the lower module when said lower module is in an intermediate position between the first latching lug and the second latching lug.

* * * * *